US005598805A

United States Patent [19]

Obrinski

[11] Patent Number: 5,598,805

[45] Date of Patent: Feb. 4, 1997

[54] MOORING LINE RECEPTACLE APPARATUS

[76] Inventor: Bradley A. Obrinski, 38716 Golfview, Clinton Township, Mich. 48038

[21] Appl. No.: 540,081

[22] Filed: Oct. 6, 1995

[51] Int. Cl.[6] ..... B63B 17/00

[52] U.S. Cl. ..... 114/230; 114/218; 114/221 R

[58] Field of Search ..... 114/218, 230, 114/221 R; 24/115 A, 129 R, 129 D

[56] References Cited

U.S. PATENT DOCUMENTS

| | | | |
|---|---|---|---|
| 2,832,116 | 4/1958 | Clevett, Jr. et al. | 24/129 D |
| 3,841,685 | 10/1974 | Kolodziej | 114/230 |
| 4,109,603 | 8/1978 | Guthmann | 114/230 |
| 4,114,553 | 9/1978 | Zikek | 114/230 |
| 4,519,643 | 5/1985 | Harris | 114/221 R |
| 4,648,159 | 3/1987 | Dougherty | 24/129 R |
| 4,912,816 | 4/1990 | Brandt | 114/230 |
| 5,050,813 | 9/1991 | Ishikawa et al. | 24/129 R |

*Primary Examiner*—Sherman Basinger
*Attorney, Agent, or Firm*—Peter D. Keefe

[57] ABSTRACT

A mooring line receptacle apparatus for a watercraft includes an elongated mooring line receptacle for each mooring line, wherein each mooring line receptacle is connected with the hull of the watercraft at the gunwale thereof; and further includes an abutment member connected with each mooring line at a distal end thereof. The mooring line receptacle has an interior hollow defined by a sidewall composed of a durable, resilient material having a slot therein along its entire length. The sidewall opposite the slot is attached to the hull of a selected watercraft via threaded fasteners. One mooring line receptacle is located at the port bow, another at the starboard bow, another at the port stern and another at the starboard stern. Preferably, each of the sets of port and starboard mooring line receptacles end near each other at a generally amidship location on the gunwale where the skipper and crew/passengers enter and leave the watercraft. The mooring line is composed of conventional material used for nautical moorage, and has an abutment member at its distal end. The slot has a width smaller than the cross-section of the mooring line, such that the mooring line can be forced through the slot into the interior hollow of the mooring line receptacle, and thereupon is trapped therein such that the mooring line cannot fall out of the hollow through the slot, nor, via the abutment member, slide therein at the distal end.

14 Claims, 1 Drawing Sheet

MOORING LINE RECEPTACLE APPARATUS

BACKGROUND OF THE INVENTION

1. Field of the Invention

The present invention relates to mooring lines used for mooring watercraft to dock facilities, and more particularly to a receptacle located on the watercraft for storing the mooring line in a ready to use outstretched configuration when the mooring line is not in use.

2. Description of the Prior Art

Watercraft, such as motor and sail boats, utilize fore and aft mooring lines at each of the port and starboard sides thereof to secure the watercraft to a dock facility. In this regard, the dock facility generally has a number of cleats or other structures, such as pilings, to which mooring lines of the watercraft may be connected.

Typically, a watercraft will have a mooring line for being connected with cleats on the watercraft in anticipation of future and present docking needs. Cleats are usually provided fore and aft at each of the starboard and port sides of the watercraft, whereupon four mooring lines would be needed to be connected to these four cleats.

Problematically, when a skipper leaves dock, the mooring lines may be loosely placed on the boat deck, whereafter they may slide off and then dangle into the water. Dangling mooring lines are, of course, unsightly and they can add drag and pose other problems to operation of the watercraft. On the other hand, if the mooring lines are secured to some component of the boat deck to prevent potential dangling, then when the mooring lines need to be made ready for docking considerable time and effort must be expended to free the lines. This lost time could be critical if a skipper is in need of a fast securement to the dock in the event of an untoward docking situation, such as when other boats may limit free navigation or high seas or winds make docking particularly tricky.

Accordingly, what is needed in the art is some effective, simple and easy to use way to hold mooring lines in a stored state, yet be instantly available when docking is imminent.

SUMMARY OF THE INVENTION

The present invention provides and effective, simple and easy to use way to hold mooring lines in a stored state with respect to the watercraft, yet the mooring lines are instantly available when docking is imminent.

The mooring line receptacle apparatus according to the present invention includes an elongated mooring line receptacle for each mooring line, wherein each mooring line receptacle is connected with the hull of the watercraft at the gunwale thereof; and further includes a mooring line having an abutment member connected to the distal end thereof. The mooring line receptacle has an interior hollow formed by a sidewall composed of a durable, resilient material having a longitudinal slot therein. The sidewall opposite the slot is attached to the hull of a selected watercraft via threaded fasteners. One mooring line receptacle is located at the port bow, another at the starboard bow, another at the port stern and another at the starboard stern. Preferably, each of the sets of port and starboard mooring line receptacles end near each other at a location on the gunwale where the skipper and crew/passengers enter and leave the watercraft, generally amidship of the watercraft. The mooring line is conventional nylon or other rope material used for nautical moorage. The slot has a width smaller than the cross-section of the mooring line, such that the mooring line can be forced progressively through the slot into the interior hollow of the mooring line receptacle, and thereupon be trapped therein such that the mooring line cannot fall out of the hollow through the slot. The abutment member then abuts the end of the mooring line receptacle to thereby prevent the distal end of the mooring line from sliding into the interior hollow.

In operation, each of the port bow, port stern, starboard bow and starboard stern mooring lines have the proximate ends thereof looped over or otherwise connected with their respective cleat on the watercraft. Each mooring line is then respectively pressed into its mooring line receptacle progressively along the slot thereof. When docking, the skipper or a crew member grabs a mooring line, via the abutment member thereof, on the side of the watercraft facing a dock facility, and then pulls upon the mooring line to thereby free it from its mooring line receptacle via exiting progressively along the slot thereof. The person then secures that mooring line in a conventional way to the dock facility, such as for example at a dock cleat or dock piling. Other of the mooring lines are then grabbed at their respective abutment member, freed and tied as was done with the first mooring line. When it is time to shove-off, the mooring lines tied to the dock facility are released therefrom and then slipped progressively through the slot of their respective mooring line receptacles for later use when docking is to again take place.

Accordingly, it is an object of the present invention to provide a mooring line receptacle apparatus for a watercraft which provides for easy, simple, outstretched storage of mooring lines in readiness for use when docking the subject watercraft.

It is another object of the present invention to provide a mooring line receptacle apparatus which provides convenient grabbing of mooring lines for rapid deployment during dockage of the subject watercraft.

It is a further object of the present invention to provide attractive storage of mooring lines accompanied by quick ability to access the mooring lines when needed.

It is an additional object of the present invention to provide simple and easy storage of mooring lines without any possibility for the mooring lines to become tangled.

These, and additional objects, advantages, features and benefits of the present invention will become apparent from the following specification.

DETAILED DESCRIPTION OF TEE PREFERRED EMBODIMENT

Figure 1:
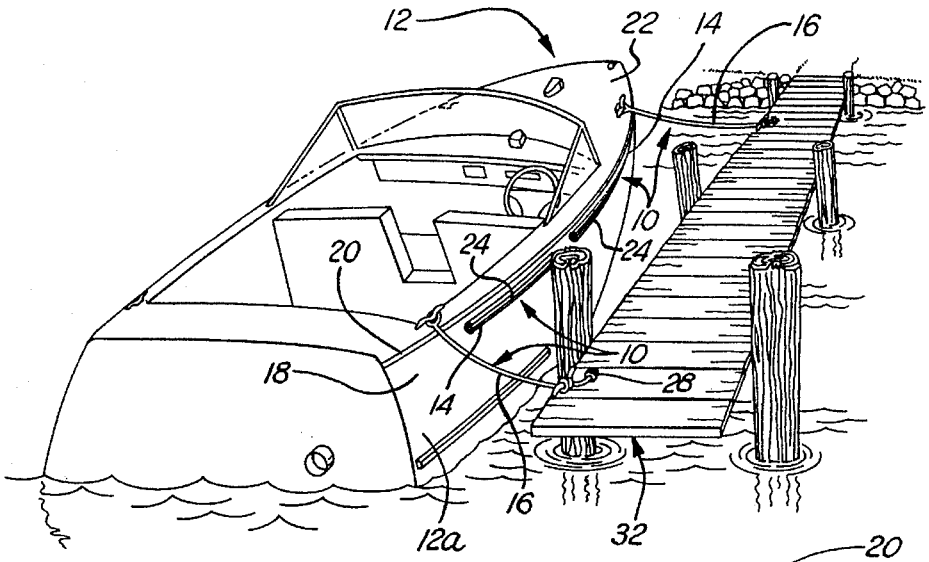
FIG. 1 is a perspective view of a watercraft equipped with the mooring line receptacle apparatus according to the present invention.
Figure 2:
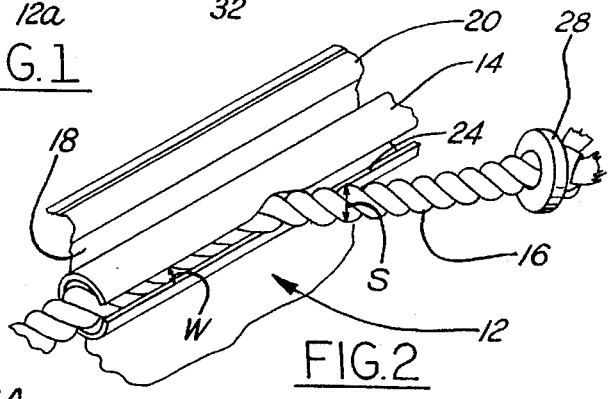
FIG. 2 is a detail perspective view showing the mooring line receptacle apparatus according to the present invention in operation.

Referring now to the Drawing, FIG. 1 shows the mooring line receptacle apparatus 10 in operation with respect to a watercraft 12. The mooring line receptacle apparatus 10 includes an elongated mooring line receptacle 14 for each mooring line 16. Each mooring line receptacle 14 is secured to the hull 12*a* of the watercraft 12 at the gunwale 18 thereof, preferably adjacent the bumper 20 (if present) at a location with respect thereto which is further below the deck 22, so that it is out of the way yet easily reached from the deck. Each mooring line receptacle 14 has an interior hollow which communicates with a slot 24 running the length thereof. In operation, each mooring line 16 is received in a releasably trapped manner into the interior hollow of a respective mooring line receptacle 14 through the slot 24 thereof, wherein the mooring line is thereafter removed therefrom via the slot in order to be used for moorage of the watercraft, as shown.

The structure and function of the mooring line receptacle apparatus 10 will now be described with greater specificity with additional reference to FIGS. 2 through 5.

Figure 3:
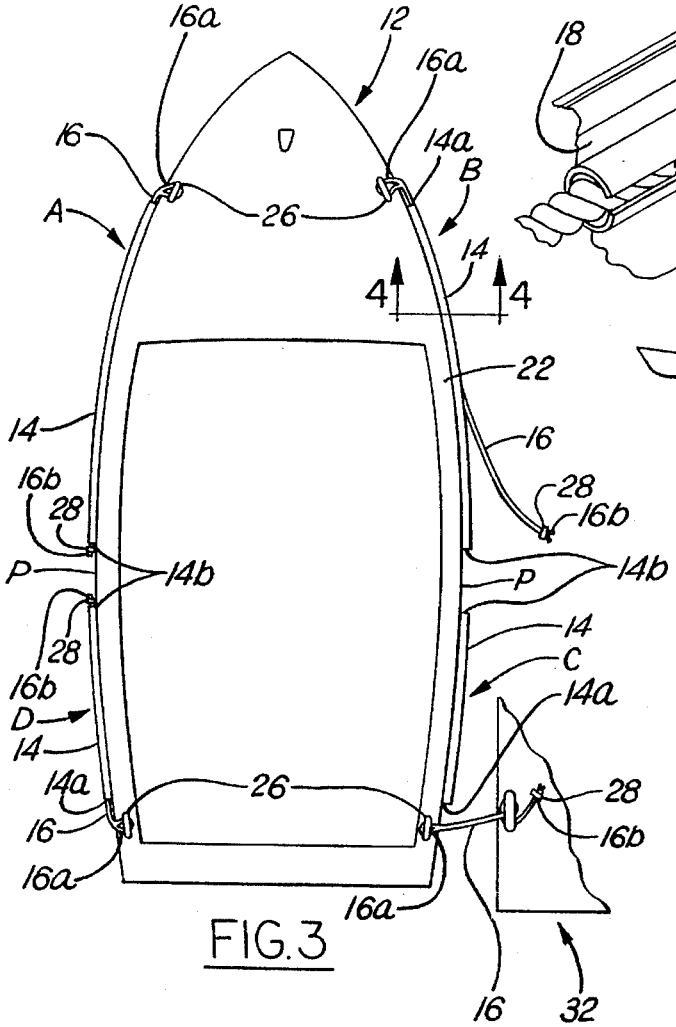
FIG. 3 is a plan view of a watercraft equipped with the mooring line receptacle apparatus according to the present invention, the bumper of the watercraft being omitted for clarity.

As indicated by FIG. 3, it is preferred to provide four mooring line receptacles 14 at each of the port bow A, starboard bow B, starboard stern C, and port stern D. In this regard, there is one mooring line receptacle 14 for each mooring line 16 of the four locations (port bow A, starboard bow B, starboard stern C, and port stern D) of cleats 26 of the watercraft 12. The proximate end 16*a* of each mooring line is connected conventionally (by a loop or a knot) with a respective cleat 26, as shown in FIG. 3. The mooring line receptacles 14 each have a near end 14*a* and a far end 14*b*, wherein the near end is located adjacent a respective cleat 26. The mooring line receptacles 14 are elongated so that at each of the port side A, D and the starboard side B, C of the watercraft 12, the far end 14*b* of the mooring line receptacles are located more-or-less amidship. There is preferred to be a small separation between the far ends 14*b* of the port A, D and starboard B, C mooring line receptacles 14. Further, as depicted in FIG. 3, it is preferred for the port bow A and starboard bow B mooring line receptacles 14 to be longer than the starboard stern C and port stern D mooring line receptacles so that the far end 14*b* thereof is located amidship further toward the stern, preferably about two-thirds the length of the water craft as measured from the bow (indicated by point P in FIG. 3).

The mooring lines 16 are composed of any nautically suitable mooring line material, such as three strand nylon. The mooring lines 16 each have a proximate end 16*a* which is connected to a respective cleat 26 of the watercraft, as discussed hereinabove. The mooring lines 16 each have an opposite distal end 16*b* which includes an abutment member 28. The abutment member 28 is structured to interface with the far end 14*b* of a respective mooring line receptacle 14, whereby the distal end 16*b* of the mooring line is abuttingly prevented from sliding into the interior hollow 30 and then becoming "lost" inside the mooring line receptacle. The abutment member 28 further serves as a convenient handle for a person to grab hold of to pull upon the mooring line 16 to thereby pullingly free it from storage within its mooring line receptacle. A preferred form of abutment member 28 is a plastic disk having a central hole through which the mooring line 16 is passed and a retaining knot tied to prevent the distal end 16*b* from passing back therethrough (see FIG. 2). In its simplest form, the abutment member could be an appropriately shed knot tied in the distal end of each of the mooring lines.

Figure 5:
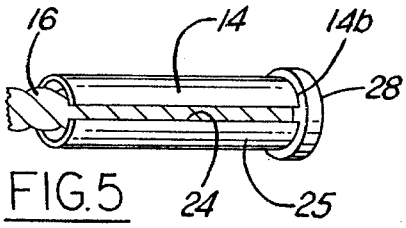
FIG. 5 is a partly sectional perspective view of the far end of a mooring line receptacle abutting the distal end of a mooring line in a manner according to the present invention.

Each mooring line 16 and its respective mooring line receptacle 14 are dimensionally paired such that the distal end 16*d* of the mooring line has only a small overlap beyond the far end of its respective mooring line receptacle when each mooring line is connected with its respective cleat 26, as generally indicated by FIG. 3. As shown in FIG. 5, the abutment member 28 abuts the far end 14*b* of the mooring line receptacle 14, such that the distal end 16*b* of the mooring line 16 cannot enter into the interior hollow 30.

Figure 4:
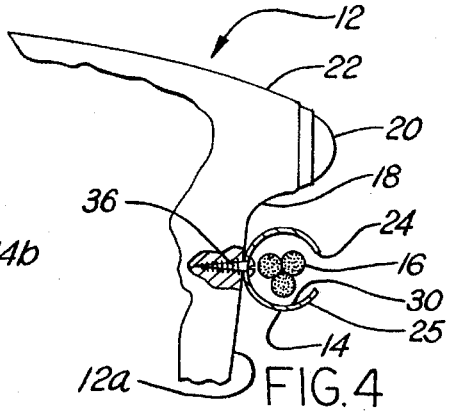
FIG. 4 is a partly sectional end view of the mooring line receptacle apparatus according to the present invention, shown in operation with respect to the gunwale of a watercraft.

Each mooring line receptacle 14 is formed of an elongated sidewall 25 composed of a durable, resilient material, preferably plastic. The sidewall 25 forms the interior hollow 30 and the slot 24 provided in the sidewall communicates with the interior hollow and runs the length thereof. A preferred cross-sectional shape of the sidewall 25 is cylindrical; if, however, added stability is desired, a flattened face may be provided at the exterior of the sidewall where it interfaces with the hull. As depicted in FIG. 4, the sidewall 25 opposite the slot 24 is attached to the hull 12*a* of a selected watercraft 12 via a number of spaced apart threaded fasteners 36, such as screws. It is preferred to connect the mooring line receptacles 14 to the hull at the gunwale, since this is out of the way and easily reached; however, the mooring line receptacles could be placed elsewhere, such as the deck, wherein the slot would be oriented so that a person on a dock facility can pull on the mooring line and thereby cause it to be released from the interior hollow via exiting along the slot.

There are preferably four mooring line receptacles 14, wherein the near end 14*a* thereof is located adjacent a respective cleat 26 at each of the port bow A, starboard bow B, starboard stern C, and port stern D (see FIG. 3). Preferably, the far end 14*b* of each of the port mooring line receptacles 14 are located separated from, but near, each other at an amidship location P on the gunwale 18 where the skipper and crew/passengers enter and leave the watercraft; likewise the starboard mooring line receptacles, as shown in FIG. 3.

The interior hollow 30 has an inside diameter exceeding the cross-section S of the mooring line 16. The slot 26 of each mooring line receptacle 14 has a width W that is smaller than the cross-section S of the mooring line 16, such that the mooring line can be forced through the slot into the interior hollow 30 of the mooring line receptacle only by resiliently deforming the sidewall adjacent the slot to thereby spread the slot to a bigger width. Once the mooring line 16 is located in the hollow 30, it is trapped therein such that the mooring line cannot fall out of the hollow through the slot 26.

In operation each of the port bow, port stern, starboard bow and starboard stern mooring lines 16 are looped or otherwise connected with their respective cleat on the watercraft. Each mooring line is then respectively pressed resiliently into its mooring line receptacle via the slot thereof, as shown at the port side in FIG. 3.

When docking, the skipper or a crew member grabs a mooring line via its abutment member 28 on the side of the watercraft facing a dock facility 32, and then pulls upon the mooring line to thereby free it from its mooring line receptacle via exiting of the mooring line progressively along the slot thereof. The person then secures that mooring line in a conventional way to the dock facility, such as for example at a dock cleat 34 or dock piling, as shown in FIGS. 1 and 3. Other of the mooring lines are then grabbed at their respective abutment member, freed and tied as was done with the first mooring line.

When it is time to shove-off, the mooring lines tied to the dock facility are released therefrom and then pressed through the slot, progressively along the subject mooring line receptacle, for later use when docking is to again take place.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A mooring line receptacle for receiving a mooring line of a watercraft comprising:

a mooring line having a predetermined cross-section, a proximate end and a distal end;

an elongated sidewall composed of a resilient material, said sidewall having a near end and an opposite far end, said sidewall forming an interior hollow having a predetermined inside diameter, said sidewall having a slot therein which communicates with said interior hollow, said slot extending from said near end to said far end, said slot having a predetermined width;

means for connecting said sidewall to a watercraft, wherein said sidewall is connected to the watercraft lengthwise between said far and near ends thereof wherein said slot is not occluded by the watercraft; and means for preventing the distal end of said mooring line placed into said interior hollow from sliding into said interior hollow;

wherein said slot has a width less than said cross-section of said mooring line and said inside diameter is larger than said cross-section of said mooring line such that said mooring line is pressed into and pulled out of said interior hollow of said mooring line receptacle by resiliently deforming said sidewall adjacent said slot, wherein said mooring line is placed into said interior hollow to thereby store at least a majority of said mooring line when not berg used to moor the watercraft.

2. A water craft and mooring line receptacle apparatus comprising:

a watercraft;

at least one mooring line receptacle connected with said watercraft, said mooring line receptacle comprising:

an elongated sidewall composed of a resilient material, said sidewall having a near end and an opposite far end, said sidewall forming an interior hollow having a predetermined inside diameter, said sidewall having a slot therein which communicates with said interior hollow, said slot extending from said near end to said far end, said slot having a predetermined width; and means for connecting said sidewall to a watercraft, wherein said sidewall is connected to said watercraft lengthwise between said far and near ends thereof wherein said slot is not occluded by the watercraft; and at least one mooring line having a predetermined cross-section larger than said width and smaller than said inside diameter;

wherein a mooring line of said at least one mooring line is placed into and pulled out of said interior hollow through said slot by resiliently deforming said sidewall adjacent said slot, wherein the mooring line is placed into said interior hollow to thereby store at least a majority of the mooring line when not being used to moor the watercraft.

3. The watercraft and mooring line receptacle apparatus of claim 2, wherein said mooring line comprises:

a mooring line having a proximate end and an opposite distal end; and abutment means located at said distal end for abutting said sidewall at said far end of said mooring line receptacle when said mooring line is at least in part placed into said interior hollow thereof so that said distal end cannot slide into said interior hollow.

4. The watercraft and mooring line receptacle apparatus of claim 3, wherein said watercraft further comprises:

a hull;

a deck connected with said hull; and a plurality of cleats connected with said deck;

wherein said mooring line and said mooring line receptacle are each dimensioned so that when said proximate end of said mooring line is connected with a selected cleat and said mooring line is placed into said hollow interior of said mooring line receptacle, then said distal end of said mooring line is located outside said mooring line receptacle such that said abutment means of said mooring line is abuttable with said far end of said mooring line receptacle.

5. The watercraft and mooring line receptacle apparatus of claim 2, wherein said watercraft further comprises:

a hull;

a deck connected with said hull; and a plurality of cleats connected with said deck; wherein said at least one mooring line receptacle comprises four mooring line receptacles comprising:

a first mooring line receptacle connected with said hull at substantially a port bow location of said watercraft;

a second mooring line receptacle connected with said hull at substantially a port stern location of said watercraft;

a third mooring line receptacle connected with said hull at substantially a starboard bow location of said watercraft; and a fourth mooring line receptacle connected with said hull at a substantially starboard stern location of said watercraft.

6. The watercraft and mooring line receptacle apparatus of claim 5, wherein said plurality of cleats comprise:

a first cleat located at said port bow of said watercraft;

a second cleat located at said port stern of said watercraft;

a third cleat located at said starboard bow of said watercraft; and a fourth cleat located at said starboard stern of said watercraft;

wherein said near end of said first mooring line receptacle is located substantially adjacent said first cleat;

wherein said near end of said second mooring line receptacle is located substantially adjacent said second cleat;

wherein said near end of said third mooring line receptacle is located substantially adjacent said third cleat; and wherein said near end of said fourth mooring line receptacle is located substantially adjacent said fourth cleat.

7. The watercraft and mooring line receptacle apparatus of claim 6, wherein said at least one mooring line comprises:

a mooring line having a proximate end and an opposite distal end; and abutment means located at said distal end for abutting said sidewall at said far end of at least one of said first, second, third and fourth mooring line receptacles when said mooring line is at least in part placed into the interior hollow thereof so that said distal end cannot slide into said interior hollow.

8. The watercraft and mooring line receptacle apparatus of claim 6, wherein said at least one mooring line comprises four mooring lines comprising:

a first mooring line having a proximate end and an opposite distal end, wherein when said proximate end of said first mooring line is connected with said first cleat and said first mooring line is placed into said hollow interior of said first mooring line receptacle, then said distal end of said first mooring line is located outside said first mooring line receptacle such that said abutment means of said first mooring line is abuttable with said far end of said first mooring line receptacle;

a second mooring line having a proximate end and an opposite distal end, wherein when said proximate end of said second mooring line is connected with said second cleat and said second mooring line is placed into said hollow interior of said second mooring line receptacle, then said distal end of said second mooring line is located outside said second mooring line receptacle such that said abutment means of said second mooring line is abuttable with said far end of said second mooring line receptacle;

a third mooring line having a proximate end and an opposite distal end, wherein when said proximate end of said third mooring line is connected with said third cleat and said third mooring line is placed into said hollow interior of said third mooring line receptacle, then said distal end of said third mooring line is located outside said third mooring line receptacle such that said abutment means of said third mooring line is abuttable with said far end of said third mooring line receptacle; and a fourth mooring line having a proximate end and an opposite distal end, wherein when said proximate end of said fourth mooring line is connected with said fourth cleat and said fourth mooring line is placed into said hollow interior of said fourth mooring line receptacle, then said distal end of said fourth mooring line is located outside said fourth mooring line receptacle such that said abutment means of said fourth mooring line is abuttable with said far end of said fourth mooring line receptacle.

9. The watercraft and mooring line receptacle apparatus of claim 8, wherein said far end of each of said first and second mooring line receptacle members are proximate each other substantially amidship of said watercraft; and wherein said far end of each of said third and fourth mooring line receptacle members are proximate each other substantially amidship of said watercraft.

10. The watercraft and mooring line receptacle apparatus of claim 2, wherein said watercraft has a gunwale; further wherein said at least one mooring line receptacle is connected to said watercraft substantially adjacent to, and substantially parallel with, said gunwale.

11. A method for storing a mooring line of a watercraft when the mooring line is not being used to moor the watercraft, the mooring line having a cross-section, said method comprising the steps of:

providing a mooring line having a cross-section;

forming an elongated member having a sidewall having a near end and an opposite far end, wherein said sidewall provides an interior hollow extending between the near and far ends;

forming a slot in said sidewall between the near and far ends thereof, wherein the slot has a width that is less than the cross-section of the mooring line;

connecting the elongated member lengthwise between the near and far ends thereof to a watercraft, wherein the slot is unobstructed by the watercraft; and placing the mooring line into the interior hollow by passing the mooring line through the slot where during the sidewall resiliently deforms so that at least a majority of the mooring line is situated storingly in the interior hollow.

12. The method of claim 11, wherein the watercraft has a cleat to which is attached the mooring line; said step of connecting further comprising locating the near end of the sidewall substantially near the cleat and the far end of the sidewall remotely from the cleat.

13. The method of claim 12, wherein the watercraft has a gunwale; said step of connecting further comprising locating the elongated member conformably in line with and substantially adjacent to the gunwale.

14. The method of claim 11, further comprising the step of pulling the mooring line out of the interior hollow through the slot by resiliently deforming the sidewall adjacent the slot.

* * * * *

UNITED STATES PATENT AND TRADEMARK OFFICE

CERTIFICATE OF CORRECTION

PATENT NO. : 5,598,805

DATED February 4, 1997

INVENTOR(S) : Bradley A. Obrinski

It is certified that error appears in the above-identified patent and that said Letters Patent is hereby corrected as shown below:

At Column 4, line 36, after "slot" delete "26" and insert therefor --24--.

At Column 4, line 44, after "slot" delete "26" and insert therefor --24--.

At Column 4, line 59, after "cleat" delete "34".

Signed and Sealed this

Eighth Day of July, 1997

Bruce Lehman

*Attest:*

BRUCE LEHMAN

*Attesting Officer*

*Commissioner of Patents and Trademarks*